US006002215A

United States Patent [19]

Yamashita et al.

[11] Patent Number: 6,002,215

[45] Date of Patent: Dec. 14, 1999

[54] LIGHTING CIRCUIT FOR DISCHARGE LAMP

[75] Inventors: Masayasu Yamashita; Atsushi Toda; Jun Yabuzaki, all of Shimizu, Japan

[73] Assignee: Koito Manufacturing Co., Ltd., Tokyo, Japan

[21] Appl. No.: 09/079,194

[22] Filed: May 15, 1998

[30] Foreign Application Priority Data

May 16, 1997 [JP] Japan ..... 9-126907

[51] Int. Cl.[6] ..... G05F 1/00

[52] U.S. Cl. ..... 315/308; 315/307; 315/224; 315/209 R; 315/DIG. 7; 315/82

[58] Field of Search ..... 315/308, 307, 315/310, 291, 209 R, 224, 127, 128, DIG. 5, DIG. 7, 82; 307/10.8; 361/79

[56] References Cited

U.S. PATENT DOCUMENTS

| | | | |
|---|---|---|---|
| 5,068,570 | 11/1991 | Oda et al. | 315/128 |
| 5,140,229 | 8/1992 | Yagi et al. | 315/307 |
| 5,142,203 | 8/1992 | Oda et al. | 315/308 |
| 5,151,631 | 9/1992 | Oda et al. | 315/127 |
| 5,177,397 | 1/1993 | Nagasawa et al. | 313/318 |
| 5,212,428 | 5/1993 | Sasaki et al. | 315/308 |
| 5,269,588 | 12/1993 | Oda et al. | 315/308 |
| 5,278,452 | 1/1994 | Matsumoto et al. | 307/10.8 |
| 5,295,036 | 3/1994 | Yagi et al. | 361/79 |
| 5,422,548 | 6/1995 | Yamashita et al. | 315/308 |
| 5,449,973 | 9/1995 | Yamashita et al. | 315/82 |
| 5,485,059 | 1/1996 | Yamashita et al. | 315/307 |
| 5,486,740 | 1/1996 | Yamashita et al. | 315/308 |
| 5,514,935 | 5/1996 | Oda et al. | 315/82 |
| 5,565,743 | 10/1996 | Yamashita et al. | 315/310 |
| 5,572,094 | 11/1996 | Yamashita et al. | 315/308 |
| 5,629,588 | 5/1997 | Oda et al. | 315/308 |
| 5,663,613 | 9/1997 | Yamashita et al. | 315/308 |
| 5,705,898 | 1/1998 | Yamashita et al. | 315/308 |

FOREIGN PATENT DOCUMENTS

| | | |
|---|---|---|
| 41 29 557 | 3/1992 | Germany . |
| 41 34 537 | 4/1992 | Germany . |
| 41 17 589 | 12/1992 | Germany . |
| 43 22 139 | 1/1994 | Germany . |
| 43 42 590 | 6/1995 | Germany . |
| 195 33 103 | 3/1996 | Germany . |
| 197 13 935 | 10/1997 | Germany . |

*Primary Examiner*—Haissa Philogene
*Attorney, Agent, or Firm*—Sughrue, Mion, Zinn, Macpeak & Seas, PLLC

[57] ABSTRACT

A lighting circuit for a discharge lamp which reliably detects short-circuiting of, or current leakage from, a discharge. A lighting circuit 1 has DC-AC conversion means 3 for converting a DC voltage from the DC power supply 2 to an AC voltage and supplying the AC voltage to the discharge lamp 9. The lighting circuit further comprises sampling means 4 for sampling a lamp voltage or a lamp current of the discharge lamp 9 in synchronism with a drive signal Sp sent to the DC-AC conversion means 3 to generate an AC wave, and abnormality determining means 5 for determining short-circuiting of, or current leakage from, the discharge lamp 9 based on a detection signal from the sampling means 4. When an abnormality is detected, power supply to the discharge lamp 9 is stopped.

11 Claims, 9 Drawing Sheets

14
15
16
17
18
19
20
21
22
23
24
25
26
27
28
E1
E2
SL
Sp
D
CK
Q
Q̄
R
Qn
CK
ϕ

SL
15A
16A
19
20
21
22
23
24
25
26
27
28
29
30
31
32
34
35
36
37
38
D
Q
CK
R
Qn
Delay Signal of SP

LIGHTING CIRCUIT FOR DISCHARGE LAMP

BACKGROUND OF THE INVENTION

1. Field of the Invention

The present invention relates to a lighting circuit capable of coping with short-circuiting of and current leakage from, a discharge lamp.

2. Description of the Related Art

Recently, greater attention is being paid to a compact discharge lamp (a metal halide lamp or the like) as a light source for vehicular lamps. As shown in FIG. 11, for example, a known lighting circuit a includes a DC power supply b, a switching power supply circuit c, and a DC-AC converter d.

In this lighting circuit a, a DC voltage, which is acquired by the switching power supply circuit c based on the voltage from the DC power supply b, is converted by the DC-AC converter d to an AC voltage of a rectangular wave, which is in turn supplied to a discharge lamp f via a current-limiting inductive element e.

FIG. 12 shows a lighting circuit g as a known lighting system, which supplies an AC voltage of a negative rectangular wave to a discharge lamp. The lighting circuit g comprises a DC power supply b, a switching power supply circuit h and a DC-AC converter i. In this circuit g, the switching power supply circuit h and the DC-AC converter i generate a negative rectangular wave based on the voltage from the DC power supply b, and this rectangular wave is then supplied to the discharge lamp f via the current-limiting inductive element e.

When one electrode of a discharge lamp contacts a conductive member or the like to cause short-circuiting or the electrodes are wetted with water or the like, resulting in a current leakage, the conventional lighting circuits are likely to suffer increased power loss, which will heat the circuit.

With the discharge lamp f having connector terminals ja and jp as shown in FIG. 11, for example, when a current leakage occurs on the jb side in the lighting circuit a, the output current is separated into a lamp current IL and a leak current Ir as indicated by the arrows.

Although the lighting circuit a tries to perform power control on the discharge lamp based on the lamp current IL of the discharge lamp f or its equivalent current detected (e.g., the lamp current is detected by means of a detecting resistor k provided between the switching power supply circuit c and the DC-AC converter d) at that time, some of the power supplied to the discharge lamp from the switching power supply circuit c leaks out in the phase where the potential at the connector terminal ja is low and the potential at the connector terminal jb is high, the lamp current decreases or the discharge lamp becomes off (IL=0), or the lamp voltage drops (to a level equal to the product of the leak current Ir and leak impedance Z or the product of the lamp current and lamp impedance) and, at the same time, the leak current Ir is not detected. When control is carried out to ignite the discharge lamp f on, for example, the rated power, therefore, the power that is output from the lighting circuit a becomes greater than the rated one due to the leak current.

In the lighting circuit g in FIG. 12, when a current leak occurs, the leak current Ir flows into the lighting circuit from the ground through the leak impedance Z and the leak current flows across a detecting resistor k' provided between the switching power supply circuit h and the DC-AC converter i. This may cause erroneous detection at the detecting resistor k' that is provided to detect the lamp current, so that the discharge lamp f, even in an off state, is erroneously determined as if it is on, as a result of detecting the current that includes the leak current.

One possible way of overcoming this shortcoming is to detect the lamp voltage or its equivalent signal, pass it through a low-pass filter and inhibit the operation of the lighting circuit when the lamp voltage drastically varies.

While this scheme is effective when the discharge lamp becomes off at the time the current leaks in the lighting circuit a in FIG. 11, however, the scheme still has a difficulty in detecting current leakage when the discharge lamp does not become off upon occurrence of current leakage unless the detection sensitivity is increased considerably by properly setting the time constant of the low-pass filter. It is therefore hard to distinguish between the normal lighting of the discharge lamp and the state of the discharge lamp at the time current leakage occurs. The lighting circuit g in FIG. 12 has a similar shortcoming besides a difficulty in deciding the reference level for determining at which pulse width of the detection signal, obtained in response to a drastic variation in lamp voltage, the operation of the lighting circuit should be stopped.

In a case where a drastic variation occurs in the voltage from the DC power supply b, depending on the frequency of the variation, the lamp voltage or the lamp current may show a change similar to what occurs at the time of current leakage, even when short-circuiting of the discharge lamp or current leakage has not occurred. At this time, erroneous detection may happen.

Accordingly, it is an object of this invention to reliably detect short-circuiting of, or current leakage from, a discharge lamp.

SUMMARY OF THE INVENTION

To achieve this object, according to this invention, a fighting circuit for a discharge lamp having a DC power supply and DC-AC conversion means for converting a DC voltage from the DC power supply to an AC voltage and supplying the AC voltage to the discharge lamp comprises sampling means for sampling a lamp voltage or a lamp current of the discharge lamp in synchronism with a drive signal sent to the DC-AC conversion means to generate an AC wave; and abnormality determining means for determining short-circuiting of, or current leakage from, the discharge lamp based on a detection signal from the sampling means.

According to this invention, as short-circuiting of, or current leakage from, a discharge lamp is detected based on sampled value of the lamp voltage or the lamp current of the discharge lamp, which are acquired in synchronism with the drive signal to the DC-AC conversion means, the status of the discharge lamp at the time the polarity of an AC wave to be supplied to the discharge lamp is inverted can be detected reliably.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENT

Figure 1:
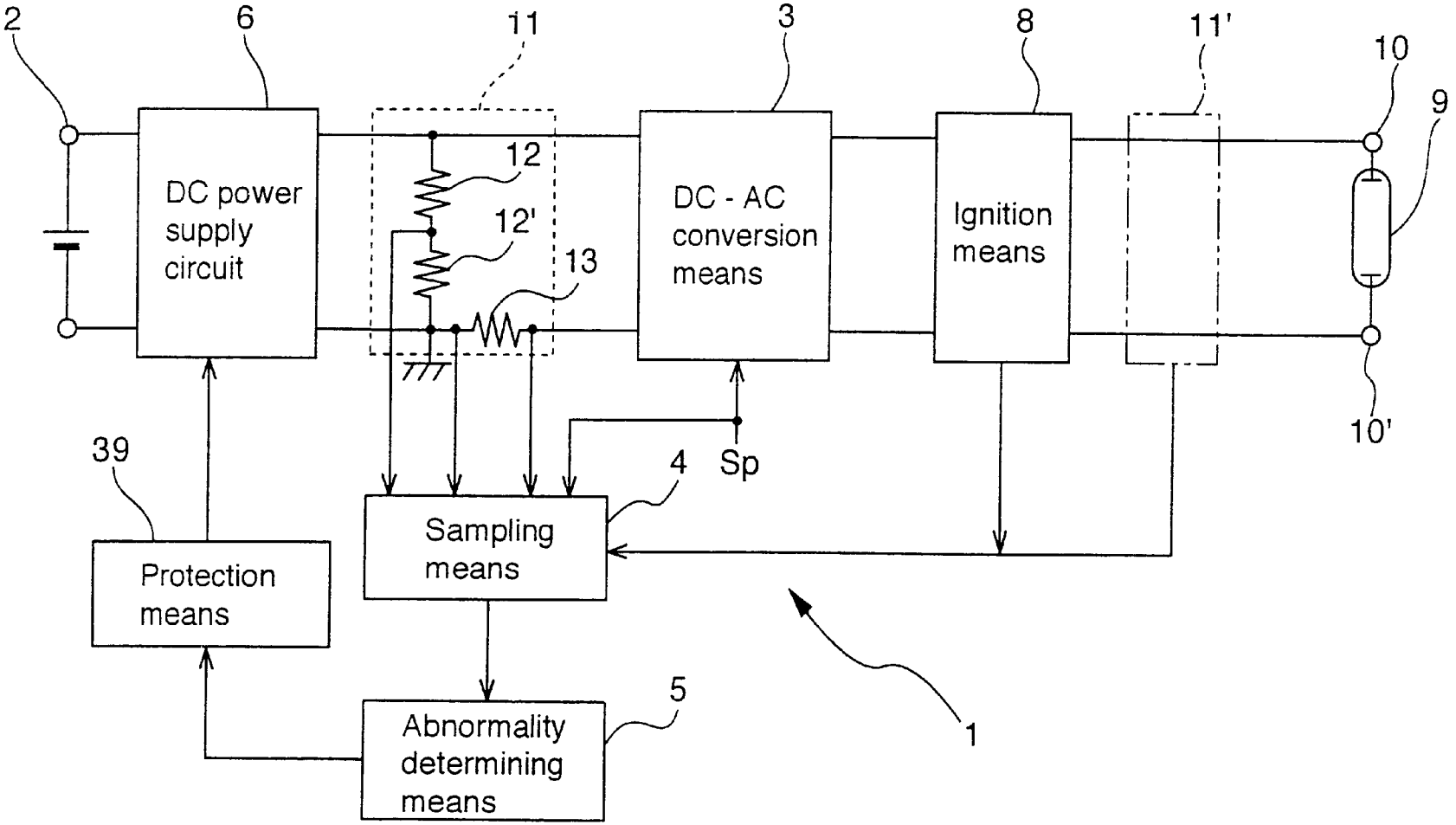
FIG. 1 is a circuit block diagram for explaining the basic constitution of a lighting circuit according to this invention.

FIG. 1 shows the basic constitution of a lighting circuit according to this invention. This lighting circuit 1 comprises a DC power supply 2, DC-AC conversion means 3, sampling means 4 which samples the lamp voltage or lamp current of a discharge lamp 9, and abnormality determining means 5 which determines short-circuiting of, or current leakage from, the discharge lamp 9 based on a detection signal from the sampling means 4.

A supply voltage from the DC power supply 2 is sent to a DC power supply circuit 6, which generates a desired DC voltage to be supplied to the DC-AC conversion means 3 at the subsequent stage. The DC power supply circuit 6 may take the constitution of a switching power supply circuit, i.e., any known constitution, such as a chopper type, forward type, flyback type, half bridge type or full bridge type.

Figure 2:
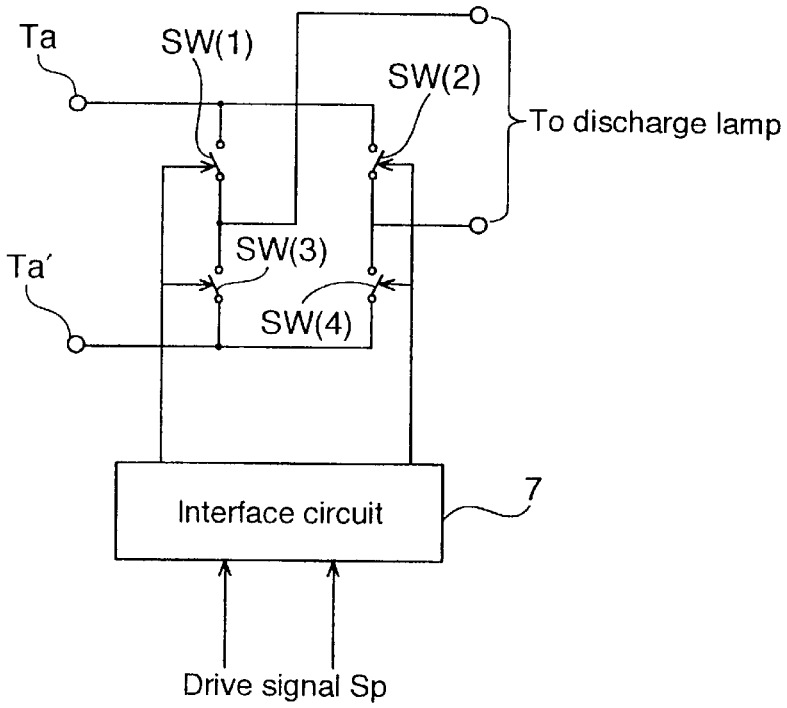
FIG. 2 is an equivalent circuit diagram exemplifying the constitution of DC-AC conversion means.

The DC-AC conversion means 3 is provided to convert a DC voltage based on the voltage from the DC power supply 2 (i.e., the output voltage of the DC power supply circuit 6 in FIG. 1) to an AC voltage and supply the AC voltage to the discharge lamp 9. The polarity of the AC wave is defined by a drive signal (denoted by "Sp"). In the case of taking a full bridge type constitution using four semiconductor switch elements SW(i) (i=1 to 4; those elements are transistors or the like and expressed by switch symbols in FIG. 2) as shown in the equivalent circuit of FIG. 2, for example, the DC-AC conversion means 3 is constructed in such a way that a series circuit of the SW(1) and the SW(3) and a series circuit of the SW(2) and the SW(4) are connected in parallel, and one ends of the SW(1) and SW(2) are connected to one (Ta) of input terminals Ta and Ta' while one ends of the SW(3) and SW(4) are connected to the other input terminal Ta'. With the SW(1) and SW(4) paired and the SW(2) and SW(3) paired, the drive signal Sp (including the inverted signal of Sp) is sent via an interface circuit 7 to each pair to perform reciprocal switching control, thus yielding an output of a rectangular wave. The output voltage of the DC power supply circuit 6 is supplied to the input terminals Ta and Ta', and the voltage to be supplied to the discharge lamp 9 is taken from a node between the SW(1) and SW(3) and a node between the SW(2) and SW(4).

Ignition means 8, provided at the subsequent stage of the DC-AC conversion means 3, generates an ignition pulse to the discharge lamp 9, superimposes this pulse on the output voltage of the DC-AC conversion means 3, and then applies the resultant voltage to the discharge lamp 9, connected between AC output terminals 10 and 10' to ignite the discharge lamp 9.

The sampling means 4 is provided to sample the lamp voltage or the lamp current of the discharge lamp 9 in synchronism with the drive signal Sp. Based on a detection signal from the sampling means 4, the abnormality determining means 5 determines short-circuiting of, or current leakage from, the discharge lamp 9. To detect the lamp voltage or the lamp current of the discharge lamp 9, as shown in FIG. 1, for example, a current/voltage detector 11 is provided between the DC power supply circuit 6 a nd the DC-AC conversion means 3 to detect the output voltage of the DC power supply circuit 6 by means of voltage-dividing resistors 12 and 12' for voltage detection, or detect the output current of the DC power supply circuit 6 by means of a shunt resistor 13 for current detection. Alternatively, a current/voltage detector 11' may be provided at the subsequent stage of the DC-AC conversion means 3 as indicated by the two-dot chain line in the diagram to directly detect the lamp voltage or the lamp current of the discharge lamp 9. The current/voltage detector 11' is not necessary when a current/voltage detector provided inside the ignition means 8 or the like is used. The signal that is acquired by the detector 11 or 11' is frequently used as basic information for a control circuit which executes power control on the discharge lamp 9 by controlling the output voltage of the DC power supply circuit 6 (e.g., to ensure progressive light emission from the discharge lamp 9 at the initial lighting stage to shorten the ignition time or reignition time of the discharge lamp 9, and to permit the discharge lamp to be lit on the rated power after a flux of light from the discharge lamp becomes stable). In this case, therefore, the detector 11 or 11' need not be provided only for the sampling means 4.

The point of falling (or rising) of the drive signal Sp (or its inverted signal) is the point which indicates the last state of an AC wave in one polarity, and the lamp voltage or lamp current which is to be sampled at the timing that is synchronous with that falling (or rising) point indicates the most extreme status in the polarizing operation. When the discharge lamp goes off due to current leakage occurring at one of the electrodes of the discharge lamp, for example, sampled values of the lamp voltage are alternate repetition of a value closest to the voltage under no load and a value which is determined by (leak current)×(leak impedance). When the discharge lamp does not go off when current leakage occurs, on the other hand, sampled values of the lamp voltage are alternate repetition of a voltage value in the stable light-ON state (where the whole current is flowing in the discharge lamp without any leakage) and a voltage value in the light-ON-upon-leakage state (where the discharge lamp is on when the current leaks).

Detection of the lamp voltage or the like in synchronism with the drive signal is suitable for surely grasping the state of the discharge lamp at the time the polarity of the AC output to the discharge lamp is inverted.

There are following three schemes available as an abnormality determining method according to this invention.

(I) To determine abnormality based on time-adjacent sampled values.

(II) To determine abnormality based on sampled values around a point of rising (falling) of the drive signal.

(III) To determine abnormality based on a difference between a sampled value and an average value.

The method (I) is used to determine that short-circuiting of, or current leakage from, the discharge lamp has occurred when time-adjacent ones of sampled values of the lamp voltage or the lamp current, obtained by the sampling means 4 at the time the polarity of the drive signal is inverted, or a difference between the adjacent sampled values exceeds an allowable range.

Figure 3:
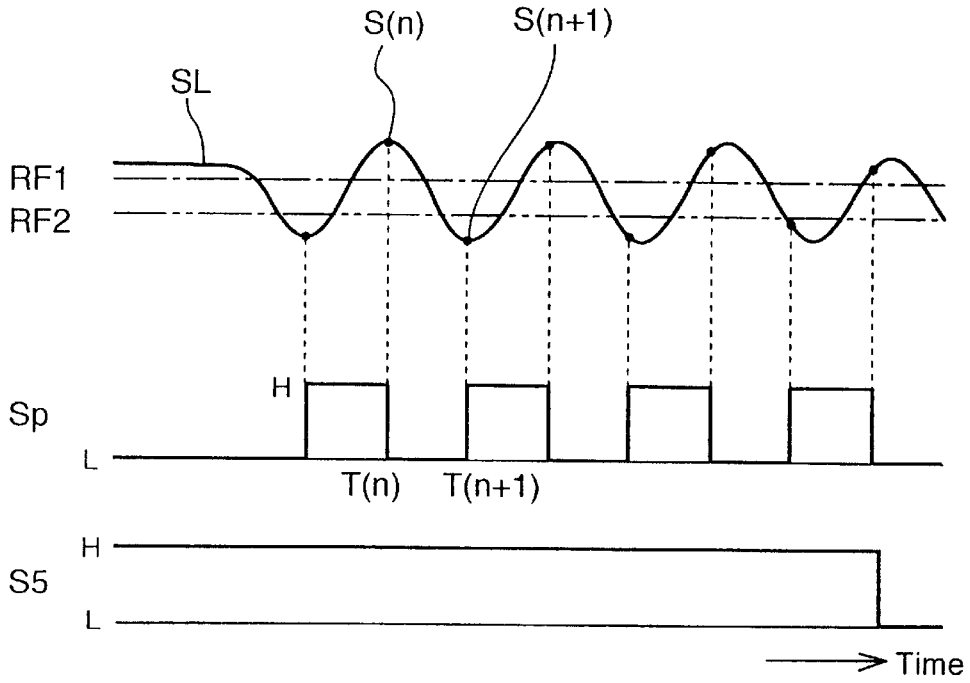
FIG. 3 is a time chart showing signal waveforms for explaining one example of an abnormality determining method together with FIG. 4.

FIG. 3 is a diagram showing one example of the determination method; "SL" indicates the lamp voltage or the lamp current or an equivalent signal of either one, and "S5" indicates the output signal of the abnormality determining means 5 (the L (Low) signal indicating the occurrence of abnormality).

Sampling the SL is carried out at the rising point or falling point of the drive signal Sp.

Then, a first reference value for comparison (denoted by "RF1") and a second reference value for comparison (denoted by "RF2"), which are set for the SL, are compared with sampled values of the SL. For example, a sampled value (S(n)) at a given sampling point T (n) is compared with the RF1 and a sampled value (S(n+1)) at the next sampling point (T(n+1)) to the sampling point T(n) is compared with the RF2. When S(n)>RF1 and S(n+1)<RF2, abnormality is determined.

In FIG. 3, the occurrence of abnormality is determined when the state of S(n)>RF1 and S(n+1)<RF2 is repeated a predetermined number of times (four times). The frequency of occurrence of erroneous detection can be reduced by determining, as apparent from FIG. 3, that short-circuiting of, or current leakage from, the discharge lamp has occurred when the state in which time-adjacent ones of sampled values of the lamp voltage or the lamp current, obtained by the sampling means 4 at the time the polarity of the drive signal is inverted, or a difference between the adjacent sampled values exceeds the allowable range, continues over a predetermined time or occurs a predetermined number of times or more.

Figure 4:
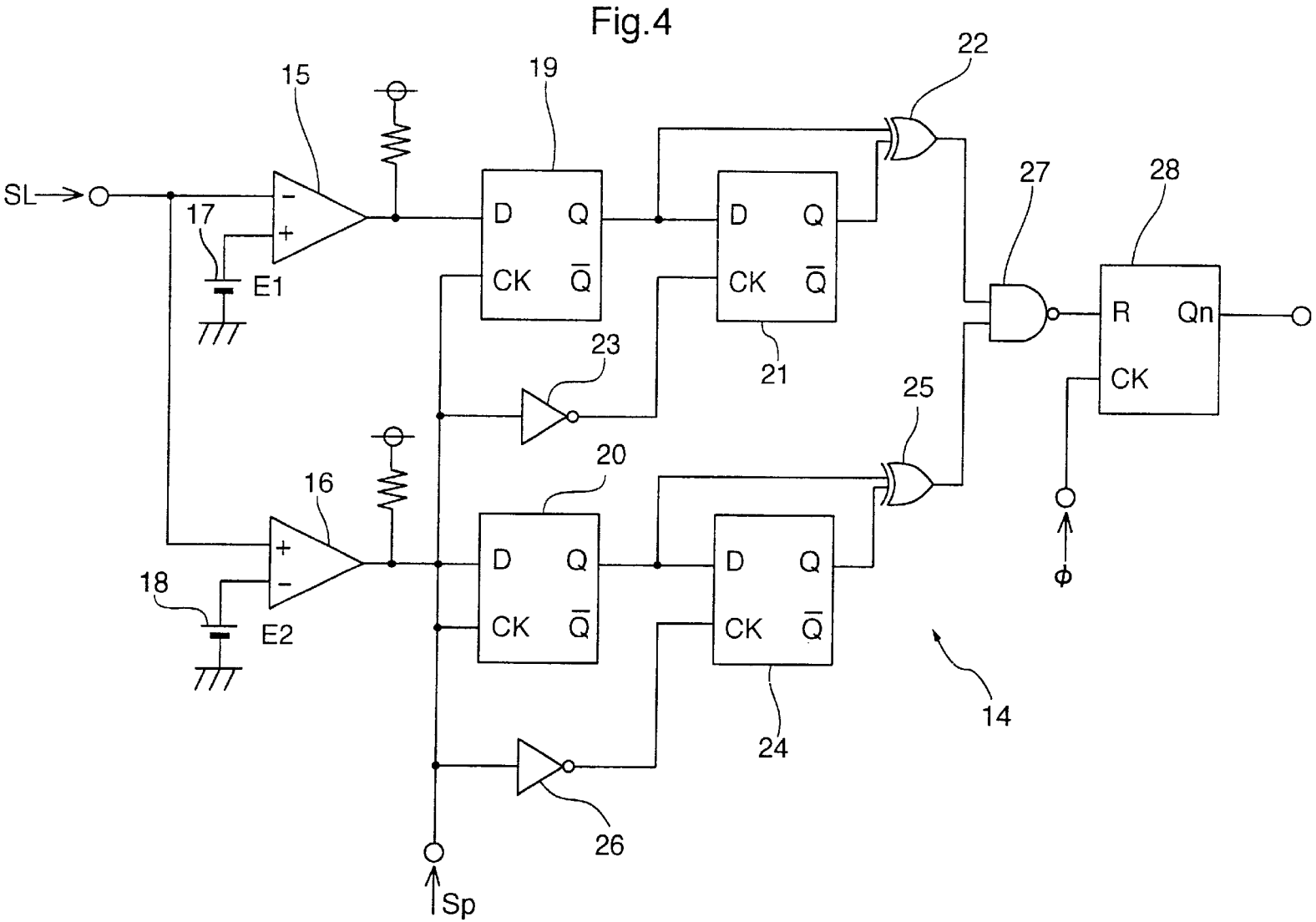
FIG. 4 is a circuit diagram exemplifying the circuit constitution.

FIG. 4 shows one example (14) of the circuit constitution in which the signal SL is sent to the negative input terminal of a comparator 15 and the positive input terminal of a comparator 16.

A reference voltage (E1) equivalent to the RF1 is supplied to the positive input terminal of the comparator 15 from a constant voltage source 17, and a reference voltage (E2) equivalent to the RF2 is supplied to the negative input terminal of the comparator 16 from a constant voltage source 18.

The output signal of the comparator 15 is sent to the D input terminal of a D flip-flop 19, and the output signal of the comparator 16 is sent to the D input terminal of a D flip-flop 20. Note that the drive signal Sp is input to the clock signal input terminals (CK) of those flip-flops 19 and 20.

The Q output of the flip-flop 19 is sent to the D input terminal of a D flip-flop 21 at the subsequent stage and one input terminal of a 2-input EXOR (Exclusive OR) gate 22. The drive signal Sp is input via a NOT gate 23 to the clock signal input terminal (CK) of the flip-flop 21 whose Q output is sent to the other input terminal of the EXOR gate 22.

The Q output of the flip-flop 20 is sent to the D input terminal of a D flip-flop 24 at the subsequent stage and one input terminal of a 2-input EXOR gate 25. The drive signal Sp is input via a NOT gate 26 to the clock signal input terminal (CK) of the a flip-flop 24 whose Q output is sent to the other input terminal of the EXOR gate 25.

The outputs of the EXOR gates 22 and 25 are sent to a 2-input NAND (Not-AND) gate 27 whose output signal is sent to the reset terminal (R) of a timer (or counter) 28.

A clock signal (ϕ) from an unillustrated signal generator is input to the clock signal input terminal (CK) of the timer 28 which outputs a signal indicative of the result of abnormality determination from its output terminal (Qn) of a predetermined stage.

In this circuit 14, the output signal of the EXOR gate 22 or 25 becomes H (High) when a state where a sampled value of the signal SL is higher than E1 and a state where a sampled value of the signal SL is lower than E2 occur successively at a timing synchronous with the drive signal Sp. This releases the reset state of the timer 28 and activates the timer 28, so that after a predetermined time elapses, the Qn output of the timer 28 changes from an L signal to an H signal which indicates abnormality.

If an up-down counter is used instead of the timer 28, it is possible to detect the frequency of occurrence of abnormality and acquire an abnormality determining signal according to this frequency. In other words, an up-down counter should be used for a case where one wants to construct the circuit in such a way that, although it is not determined as abnormal when repetition of a state where a sampled value of the signal SL is higher than E1 and a state where a sampled value of the signal SL is lower than E2 does not occur successively within the set time of the timer 28 and is interrupted even once, the frequency of occurrence of abnormality need not be taken 100% but 80% or 90% is sufficient and interruption of such repetition does not immediately result in negation of the occurrence of abnormality.

The method (II) determines that short-circuiting of, or current leakage from, the discharge lamp has occurred when a difference between sampled values of the lamp voltage or the lamp current, obtained around the rising point or falling point of drive signal Sp exceeds an allowable range.

Figure 5:
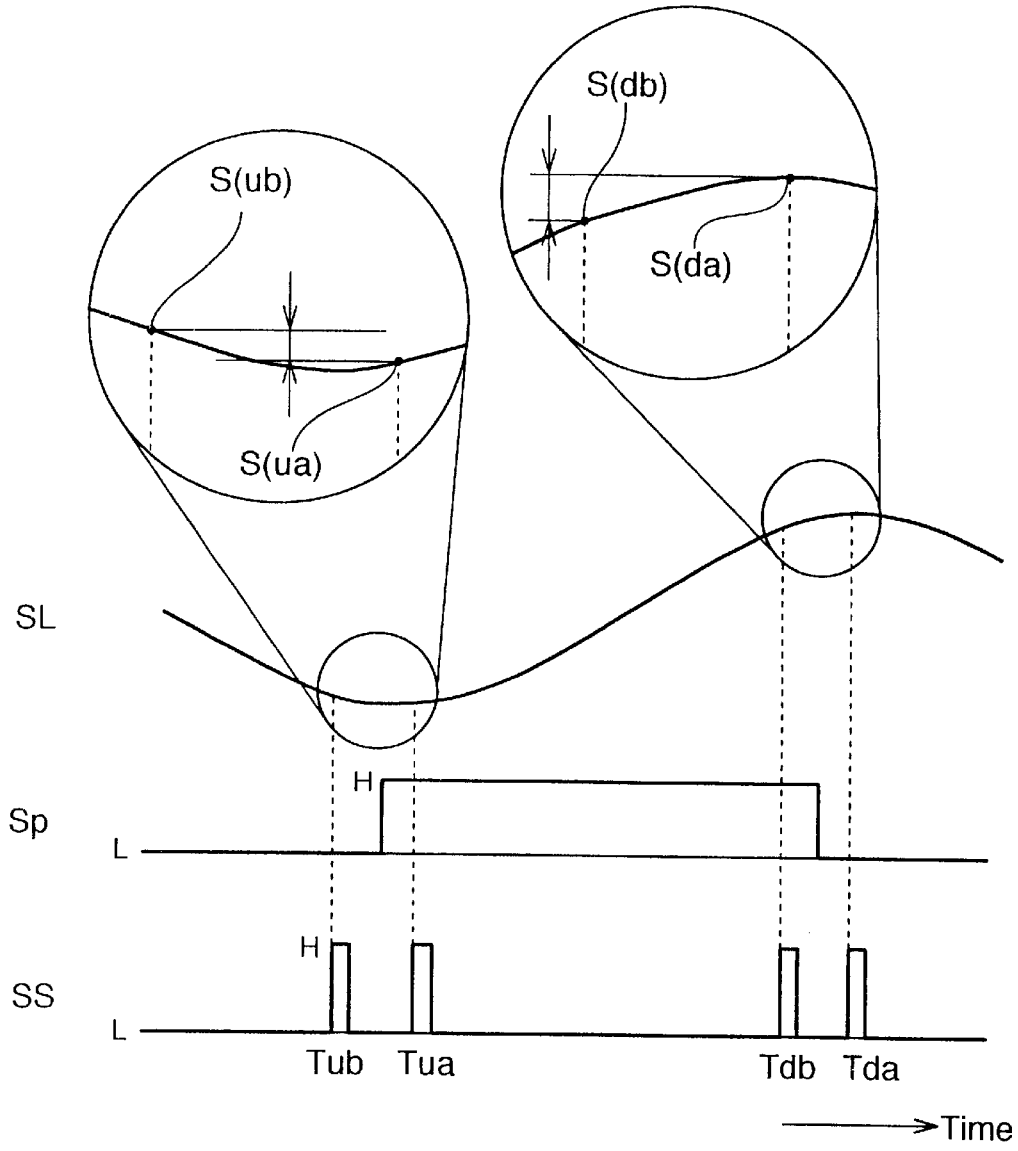
FIG. 5 is a time chart showing signal waveforms for explaining another example of an abnormality determining method together with FIGS. 6 and 7.

FIG. 5 is a waveform chart showing another example of the determination method; "SS" indicates a sampling signal (or sampling pulse) with respect to the signal SL.

Sampling the SL is carried out around the rising point or falling point of the drive signal Sp. Specifically, a sampled value (S(ub)) of the SL at a point Tub slightly before the rising point of the drive signal Sp is compared with a sampled value (S(ua)) of the SL at a point Tua slightly after the rising point of the drive signal Sp, or a sampled value (S(db)) of the SL at a point Tdb slightly before the falling point of the drive signal Sp is compared with a sampled value (S(da)) of the SL at a point Tda slightly after the falling point of the drive signal Sp.

The frequency of occurrence of erroneous detection can be reduced by determining that abnormality has occurred when the absolute value of a difference between S(ub) and S(ua) is larger than a predetermined range (for example, when S(ub)>S(ua) and the difference S(ub)–S(ua) is larger than a predetermined reference value RF3) and/or when the absolute value of a difference between S(db) and S(da) is greater than a predetermined range (for example, when S(db)<S(da) and the difference S(da)–S(db) is greater than the predetermined reference value RF3), or by determining that short-circuiting of, or current leakage from, the discharge lamp has occurred when repetition of such states continues for a predetermined time or occurs a predetermined number of times or more.

Figure 6:
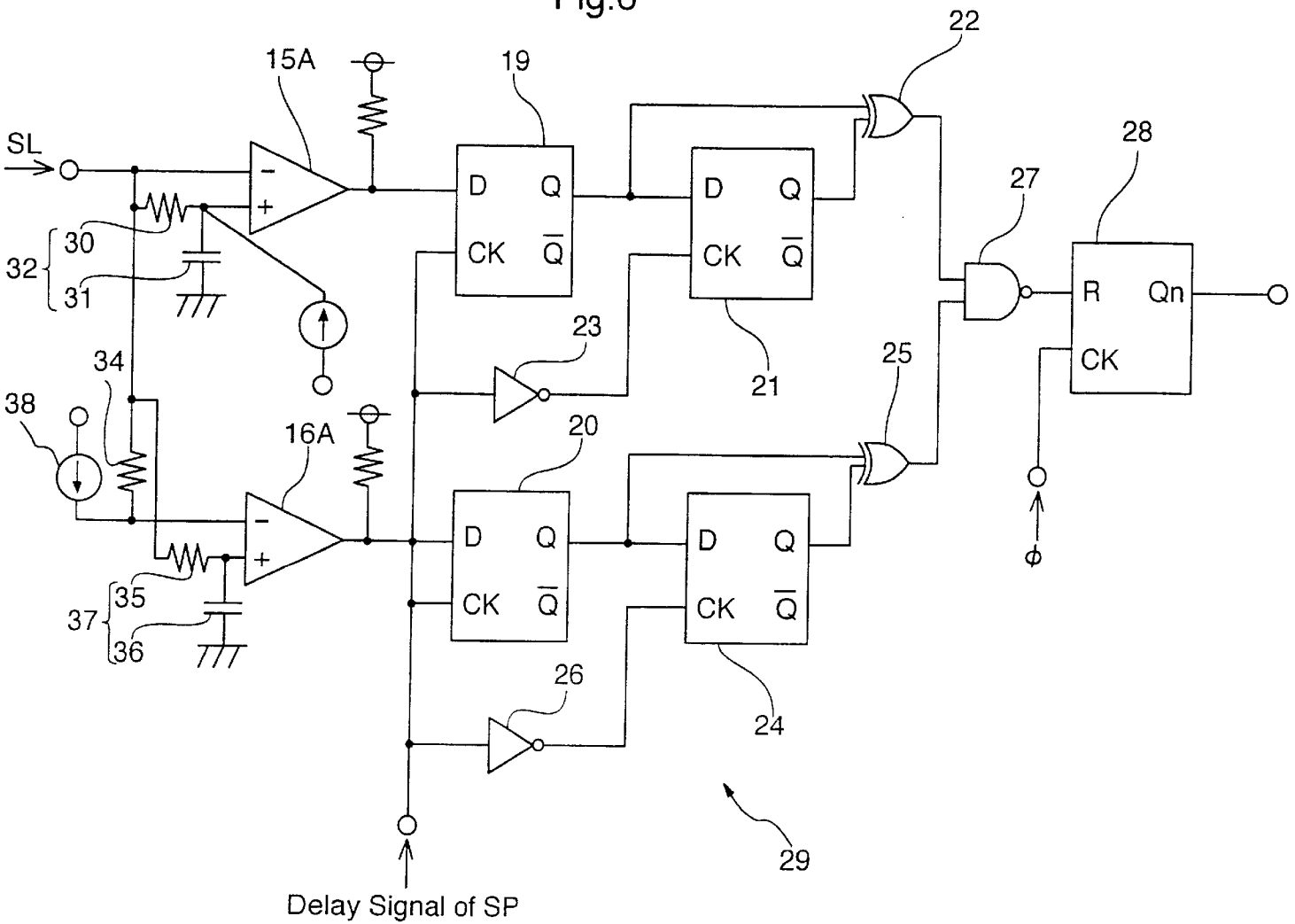
FIG. 6 is a circuit diagram depicting one example of the circuit constitution.

FIG. 6 shows another example (29) of the circuit constitution which differs from the circuit 14 in FIG. 4 only in the constitution of the input stage of a comparator and the use of a delay signal of the drive signal as a clock signal to be supplied to a D flip-flop. To avoid the redundant description, therefore, like or same reference numerals or symbols are given to those components, which are the same as the corresponding components of the circuit 14.

A comparator 15A is designed in such a manner that the signal SL is input to the negative input terminal of the comparator 15A whose positive input terminal is supplied with the signal SL via an integrator 32 which comprises a resistor 30 and a capacitor 31. A constant current source 33 is connected between the resistor 30 and the capacitor 31 to shift up the positive input voltage of the comparator 15A by a predetermined voltage.

A comparator 16A is designed in such a manner that the signal SL is input via a resistor 34 to the negative input terminal of the comparator 16A whose positive input terminal is supplied with the signal SL via an integrator 37 which comprises a resistor 35 and a capacitor 36. A constant current source 38 is connected to the negative input terminal of the comparator 16A to shift up the negative input voltage of the comparator 16A by a predetermined voltage.

The output signal of the comparator 15A is sent to the D input terminal of a D flip-flop 19, and the output signal of the comparator 16A is sent to the D input terminal of a D flip-flop 20. The other circuit constitution is the same as that of the circuit illustrated in FIG. 4. It is however to be noted that the clock signal to be sent to the flip-flops 19 to 21 and 24 is the delay signal of the drive signal SP (or its inverted signal).

In this circuit 29, the value of the time constants of the integrators 32 and 37 are defined in such a way as to form a low-pass filter whose cutoff frequency is greater than the reference frequency of the drive signal Sp, and the signal SL and a signal, obtained by filtering the signal SL through the low-pass filter, are input to the comparators 15A and 16A. Note that the signal voltage after passing the low-pass filter is shifted up in the comparator 15A while the signal voltage of the SL is shifted up in the comparator 16A.

The use of a signal slightly delayed from the drive signal Sp as a sampling signal can yield a difference between sampled values around the rising (falling) point of the drive signal Sp.

Figure 7:
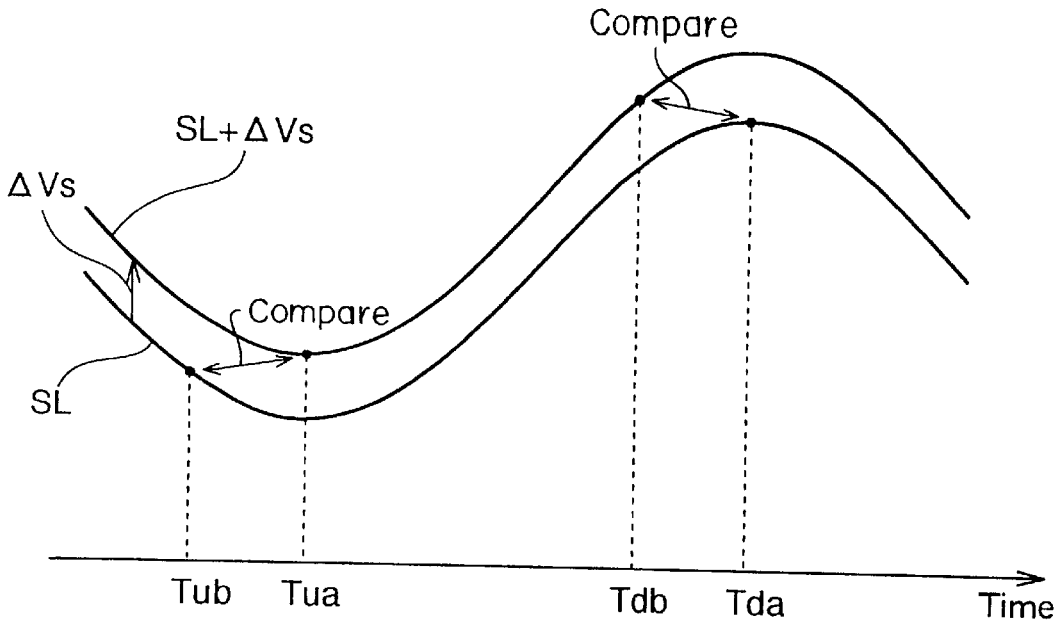
FIG. 7 is an explanatory diagram for a comparison operation.

FIG. 7 exemplifies the signal SL and a signal (SL+ΔVs) which is the signal SL shifted up by a predetermined voltage (ΔVs) ; sampled values at the sampling points Tub and Tua are compared with each other and sampled values at the sampling points Tdb and Tda are compared with each other.

The method (III) determines that short-circuiting of, or current leakage from, said discharge lamp has occurred when a difference between a sampled value of the lamp voltage or the lamp current, and an average value of the lamp voltage or the lamp current at the sampling point of the sampled value exceeds an allowable range.

Figure 8:
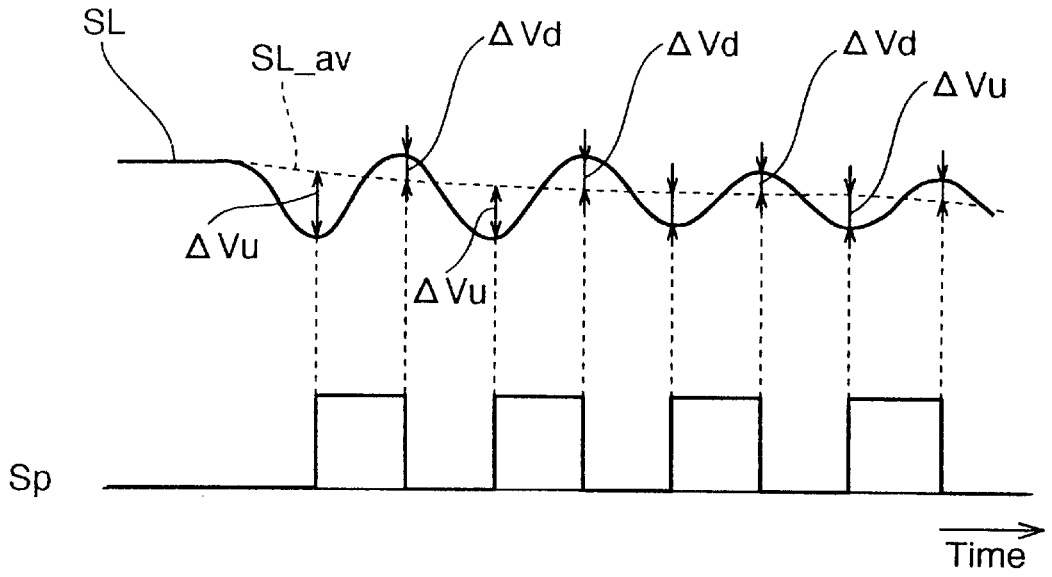
FIG. 8 is a time chart showing signal waveforms for explaining a further example of an abnormality determining method together with FIG. 9.

FIG. 8 is a waveform chart showing a further example of the determination method; SL_av indicated by the broken line represents the average value of the signal SL indicated by the solid line. The frequency of occurrence of erroneous detection can be reduced by determining that abnormality has occurred when a value (ΔVd) obtained by subtracting a sampled value of the average value SL_av from a sampled value of the SL at the falling point of the drive signal Sp is positive and is greater than a predetermined reference value RF4 or a difference (ΔVu) obtained by subtracting a sampled value of the average value from a sampled value of the SL at the rising point of the drive signal Sp is negative and the absolute value of the difference ΔVu is smaller than a predetermined reference value RF5, or by determining that short-circuiting of, or current leakage from, the discharge lamp has occurred when repetition of such states continues for a predetermined time or occurs a predetermined number of times or more.

One example of the circuit may be implemented by defining the cutoff frequency of the low-pass filter to a sufficiently small value by properly setting the time constants of the integrators 32 and 37 in FIG. 6. This circuit constitution can yield an average value of the signal SL.

Figure 9:
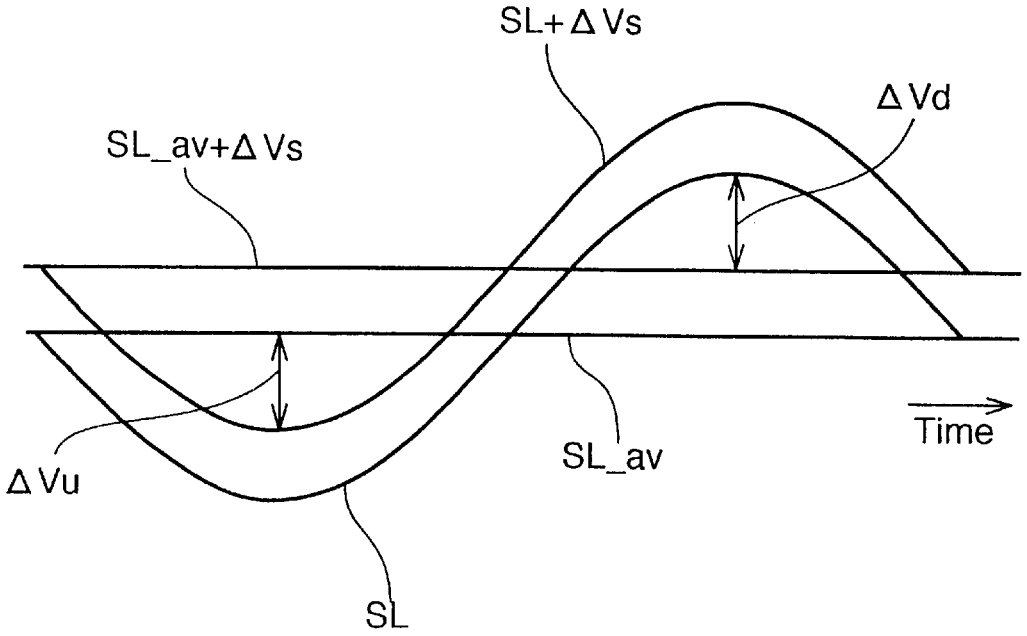
FIG. 9 is an explanatory diagram for a comparison operation.

FIG. 9 exemplifies the signal SL, a signal (SL+ΔVs) which is the signal SL shifted up by ΔVs, the average value SL_av of the signal SL and a signal (SL_av+ΔVs) which is the averaged value shifted up by ΔVs. A difference AVd between sampled values of SL_av+ΔVS and SL substantially at the falling edge of the drive signal Sp is compared with the reference value RF4, and the absolute value of a difference ΔVu between sampled values of SL+ΔVS and SL_av substantially at the rising edge of the drive signal is compared with the reference value RF5.

The computation of the average value in the method (III) can be carried out by properly using the method of moving averages (which computes an average value within a fixed or variable detection time set with a given point taken as a reference) or the method of weighted mean (which sets a weight coefficient corresponding to, for example, a time difference from a given point of time) besides the simple averaging method.

The above-described methods (I) to (III) may be used singularly or in combination. Instead of using the wired-logic based circuit constitution as shown in FIGS. 4 or 6, the circuit may be designed to perform analog-to-digital conversion of the signal SL and implement sampling, comparing and counting operations, etc. as software-based processes that are executed by a computer. This modification can ensure finer abnormality determination.

The abnormality determining means 5 stops supplying power to the discharge lamp when determining that short-circuiting of, or current leakage from, the discharge lamp has occurred. There are several ways to permit the abnormality determining means 5 to send a signal to the protection means 39 (see FIG. 1) to stop power supply to the discharge lamp 9. One scheme is to provide switch means (relay contact, a semiconductor switch element or the like) on the power supply line to the DC power supply circuit 6 from the power supply 2 and control the ON/OFF action of the switch means. Another scheme provides a constant power supply circuit, which generates a predetermined supply voltage based on the voltage from the power supply 2 and supplies the generated voltage to the DC power supply circuit 6, the DC-AC conversion means 3 and other associated components, and controls the enabling/disabling of the constant power supply circuit. The latter scheme does not have a problem associated with the contact capacitance and the withstand voltage of switch means, and can carry out control to permit or inhibit power supply to the discharge lamp relatively easily without complicating the circuit constitution and/or involving a significant cost increase.

To clearly distinguish between flickering of the discharge lamp 9 caused by short-circuiting of, or current leakage from, the discharge lamp 9 and flickering of the discharge lamp 9 caused by a variation in the voltage from the DC power supply 2, it is preferable to perform control in such a way that stopping of power supply to the discharge lamp by the abnormality determining means 5 is prohibited.

Figure 10:
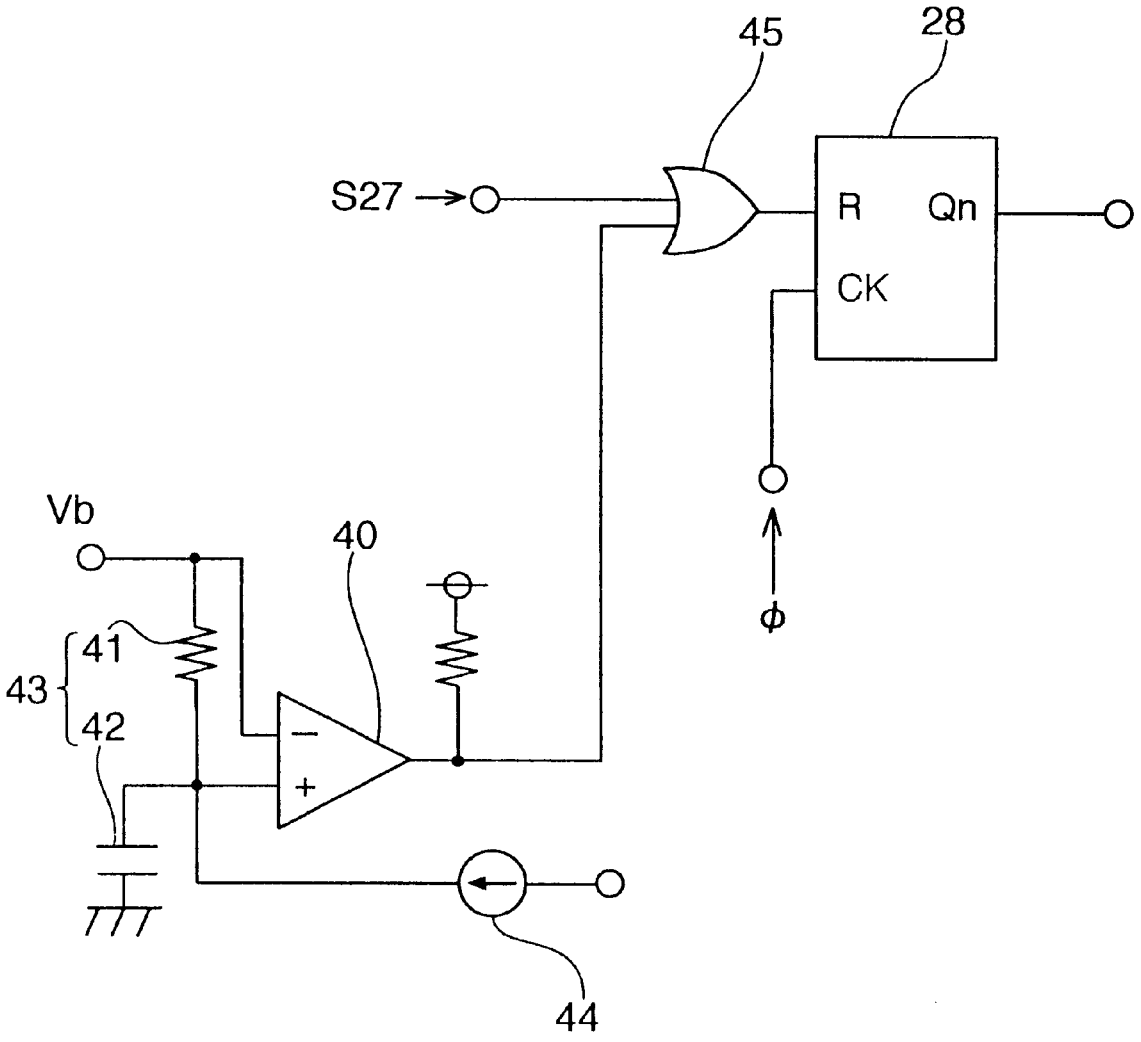
FIG. 10 is a circuit diagram depicting one example of the circuit constitution for prohibiting stopping of power supply to a discharge lamp by abnormality determining means when a variation in supply voltage is detected.
Figure 11:
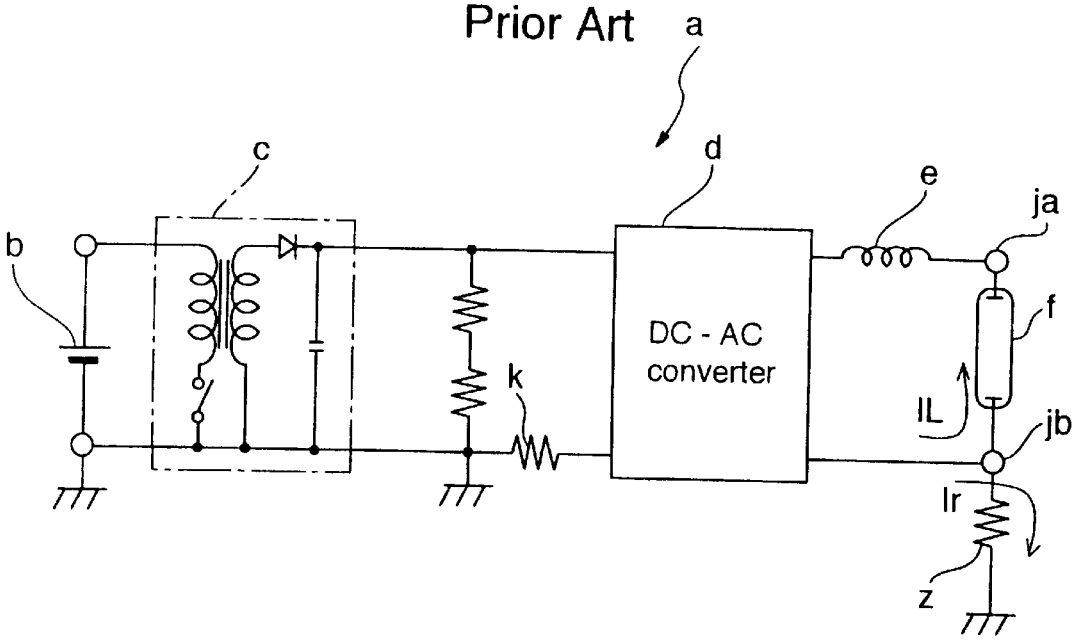
Fig. 11 Prior Art
FIG. 11 is a diagram depicting the constitution of a conventional lighting circuit.
Figure 12:
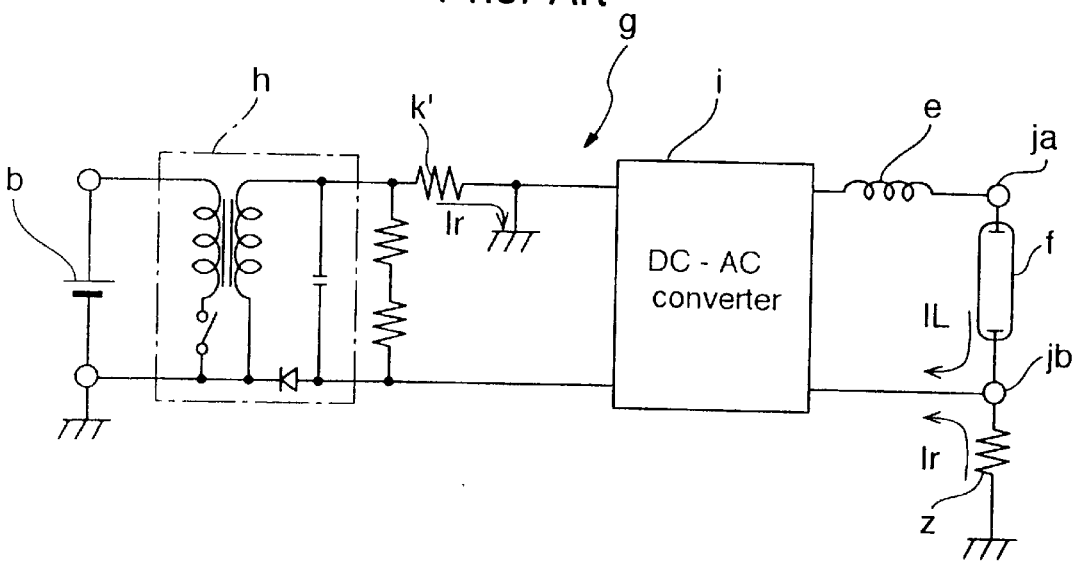
Fig. 12 Prior Art
FIG. 12 is a diagram showing another constitution different from the one in FIG. 11.

FIG. 10 exemplifies the constitution of a circuit which accomplishes such prohibition and which is so designed as to reset the timer 28 upon detection of a variation in a detection signal Vb of the voltage (or current) of the DC power supply based on the detection of an average value of the detection signal Vb.

The detection signal Vb is input to the negative input terminal of a comparator 40 directly and to the positive input terminal of the comparator 40 via an integrator 43 which comprises a resistor 41 and a capacitor 42. It is to be noted that a constant current source 44, connected to the positive input terminal of the comparator 40, shifts up the positive input voltage by a predetermined voltage.

The output signal of the comparator 40 is sent to one input terminal of a 2-input OR gate 45 whose other input terminal is supplied with the output signal of the NAND gate 27 (denoted by "S27"). The output signal of the OR gate 45 is sent to the reset terminal (R) of the timer 28 (see FIGS. 4 and 6).

In this circuit, an average value of Vb is acquired by setting the time constant of the integrator 43 and the timer 28 is reset when the comparator 40 outputs an H signal as a result of comparison between the average value and the level of Vb. That is, when the size of a variation in Vb becomes large, a change in the signal SL then is originated from a variation in the supply voltage, so that control is so performed not to allow the abnormality determining means 5 to stop power supply to the discharge lamp. The circuit may of course be designed so as to temporary stop power supply to the discharge lamp when a variation in Vb becomes prominently larger than the allowable range. Further, the degree of a variation in Vb maybe detected in two stages (large or small) or in n (>2) stages, or the degree of a variation in SL may likewise be detected in plural stages.

The circuit may be so designed as to inhibit stopping of power supply to a discharge lamp only when the frequency of a variation in supply voltage is close to the frequency of the drive signal Sp. In this case, specifically, the circuit further should comprise detection means for detecting the frequency of the output signal of the comparator 40 and determining means for determining if the former frequency is equal (or close) to the frequency of the drive signal Sp, whereby when the frequency of the output signal of the comparator 40 is equal (or close) to the frequency of the drive signal Sp, an H signal is sent to the OR gate 45 to reset the timer 28. This constitution prevents the timer 28 from being reset by a single variation in Vb, thereby reducing the frequency of occurrence of malfunction.

As apparent from the foregoing description, according to this embodiment of the invention, it is possible to reliably detect the state of a discharge lamp at the time the AC wave to be supplied to the discharge lamp is inverted, by detecting short-circuiting of, or current leakage from, the discharge lamp based on sampled values of the lamp voltage or lamp current of the discharge lamp which are acquired in synchronism with the drive signal to the DC-AC conversion means, and it is unnecessary to significantly enhance the detect-on sensitivity for that detection.

According to one modification of the embodiment, it is determined that short-circuiting of, or current leakage from, the discharge lamp has occurred when time-adjacent ones of sampled values of the lamp voltage or the lamp current, obtained at the time the polarity of the drive signal is inverted, or a difference between the adjacent sampled values exceeds an allowable range. It is thus possible to determine whether or not abnormality has occurred based on the status of the discharge lamp at the time the polarity of the drive signal is inverted.

According to another modification of the embodiment, it is determined that short-circuiting of, or current leakage from, the discharge lamp has occurred when a difference between sampled values of the lamp voltage or the lamp current, obtained around a point of rising or a point of falling of the drive signal, exceeds an allowable range. This can ensure accurate grasping of a time-dependent change in sampled values around the point of inversion of the polarity of the drive signal.

According to a further modification of the embodiment, it is determined that short-circuiting of, or current leakage from, the discharge lamp has occurred when a difference between a sampled value of the lamp voltage or the lamp current, and an average value of the lamp voltage or the lamp current at a sampling point of the sampled value exceeds an allowable range. It is therefore possible to grasp how the sampled values of the lamp voltage or the lamp current change in relative to an average value which indicates a tendency of changes in sampled values over a long period of time, thus contributing to accurate determination of abnormality.

According to a still further modification of the embodiment, power supply to the discharge lamp is stopped to turn off the discharge lamp when the abnormality determining means determines that short-circuiting of, or current leakage from, the discharge lamp has occurred. This can surely suppress power loss or prevent heat from being generated in the circuit.

According to a yet further modification of the embodiment, when a variation in supply voltage is detected, stopping of power supply to the discharge lamp by the abnormality determining means is prohibited. This can prevent flickering of the discharge lamp caused by a variation in supply voltage from being mistaken for flickering originating from short circuiting of, or current leakage from, the discharge lamp.

It should be apparent to those skilled in the art that the present invention may be embodied in many other specific forms without departing from the spirit or scope of the invention. Therefore, the present examples and embodiment are to be considered as illustrative and not restrictive and the invention is not to be limited to the details given herein, but may be modified within the scope and equivalence of the appended claims.

What is claimed is:

1. A lighting circuit for a discharge lamp having a DC power supply and DC-AC conversion means for converting a DC voltage from said DC power supply to an AC voltage and supplying said AC voltage to said discharge lamp, comprising:

sampling means for sampling a lamp voltage or a lamp current of said discharge lamp in synchronism with a drive signal sent to said DC-AC conversion means to generate an AC wave; and abnormality determining means for determining short-circuiting of, or current leakage from, said discharge lamp based on a detection signal from said sampling means.

2. The lighting circuit according to claim 1, wherein said abnormality determining means determines that short-circuiting of, or current leakage from, said discharge lamp has occurred when time-adjacent ones of sampled values of said lamp voltage or said lamp current, obtained by said sampling means at a time the polarity of said drive signal is inverted, or a difference between said adjacent sampled values exceeds an allowable range.

3. The lighting circuit according to claim 1, wherein said abnormality determining means determines that short-circuiting of, or current leakage from, said discharge lamp has occurred when a difference between sampled values of said lamp voltage or said lamp current, obtained by said sampling means around a point of rising or a point of falling of said drive signal, exceeds an allowable range.

4. The lighting circuit according to claim 1, wherein said abnormality determining means determines that short-circuiting of, or current leakage from, said discharge lamp has occurred when a difference between a sampled value of said lamp voltage or said lamp current, and an average value of said lamp voltage or said lamp current at a sampling point of said sampled value exceeds an allowable range.

5. The lighting circuit according to claim 1, wherein said abnormality determining means determines that short-circuiting of, or current leakage from, said discharge lamp has occurred when a state where a difference between a sampled value of said lamp voltage or said lamp current, and an average value of said lamp voltage or said lamp current at a sampling point of said sampled value exceeds an allowable range continues for a predetermined time.

6. The lighting circuit according to claim 1, wherein said abnormality determining means determines that short-circuiting of, or current leakage from, said discharge lamp has occurred when a state where a difference between a sampled value of said lamp voltage or said lamp current, and an average value of said lamp voltage or said lamp current at a sampling point of said sampled value exceeds an allowable range occurs a predetermined number of times.

7. The lighting circuit according to claim 1, wherein a signal delayed slightly from said drive signal is used as a sampling signal.

8. The lighting circuit according to claim 1, wherein a degree of a variation in said detection signal is detected in plural stages.

9. The lighting circuit according to claim 1, wherein when said abnormality determining means determines that short-circuiting of, or current leakage from, said discharge lamp has occurred, power supply to said discharge lamp is stopped.

10. The lighting circuit according to claim 9, wherein when a variation in power from said DC power supply is detected, stopping of power supply to said discharge lamp by said abnormality determining means is prohibited.

11. The lighting circuit according to claim 10, wherein when a frequency of a variation in said DC voltage from said DC power supply is close to a frequency of said drive signal, stopping of power supply to said discharge lamp by said abnormality determining means is prohibited.

* * * * *